US009111400B2

(12) United States Patent
Bando et al.

(10) Patent No.: US 9,111,400 B2
(45) Date of Patent: Aug. 18, 2015

(54) SYSTEM FOR DETECTING ABNORMAL DRIVING BEHAVIOR

(71) Applicants: DENSO CORPORATION, Kariya, Aichi-pref. (JP); National University Corporation Nara Institute Of Science And Technology, Ikoma, Nara-pref. (JP)

(72) Inventors: Takashi Bando, Nagoya (JP); Masumi Egawa, Aichi-ken (JP); Takatomi Kubo, Ikoma (JP); Ryunosuke Hamada, Ikoma (JP); Kazushi Ikeda, Ikoma (JP)

(73) Assignees: DENSO CORPORATION, Kariya (JP); National University Corporation Nara Institute Of Science And Technology, Ikoma (JP)

( * ) Notice: Subject to any disclaimer, the term of this patent is extended or adjusted under 35 U.S.C. 154(b) by 0 days.

(21) Appl. No.: 14/210,669

(22) Filed: Mar. 14, 2014

(65) Prior Publication Data

US 2014/0277832 A1 Sep. 18, 2014

(30) Foreign Application Priority Data

Mar. 14, 2013 (JP) ..... 2013-052115

(51) Int. Cl.
*G07C 5/00* (2006.01)

(52) U.S. Cl.
CPC ..... *G07C 5/00* (2013.01)

(58) Field of Classification Search
CPC ..... G07C 5/00; B60K 28/066
USPC ..... 701/1, 33.4; 340/439, 576, 425.5, 575; 180/272
See application file for complete search history.

(56) References Cited

U.S. PATENT DOCUMENTS

| | | | | |
|---|---|---|---|---|
| 4,604,611 | A * | 8/1986 | Seko et al. | 340/576 |
| 5,465,079 | A * | 11/1995 | Bouchard et al. | 340/576 |
| 2001/0003436 | A1 * | 6/2001 | Yoshikawa | 340/439 |
| 2011/0264325 | A1 | 10/2011 | McLaughlin et al. | |

FOREIGN PATENT DOCUMENTS

| | | |
|---|---|---|
| JP | 2009-154675 | 7/2009 |
| JP | 2009-175929 | 8/2009 |
| JP | 2011-230753 | 11/2011 |

OTHER PUBLICATIONS

Fox, E. B. et al; "Sharing Features Among Dynamical Systems With Beta Processes;" Advances in Neural Information Processing Systems, vol. 22; 2009; pp. 549-557.

* cited by examiner

*Primary Examiner* — Marthe Marc-Coleman
(74) *Attorney, Agent, or Firm* — Harness, Dickey & Pierce, PLC

(57) ABSTRACT

In an abnormal driving behavior detection system for a vehicle, an obtainer repeatedly obtains an observed value indicative of at least one of a running condition of the vehicle and a driver's driving operation of the vehicle. A mode-probability calculator calculates, each time an observed value is obtained at a given obtaining timing as a target obtained value, a mode probability for each of driving modes as a function of one or more previous observed values. A deviation calculator obtains a predicted observed value for each driving mode using a driver's normal behavior model defined therefor, and calculates a deviation of the target observed value from the predicted observed value for each driving mode. An abnormality determiner determines whether there is at least one driver's abnormal behavior based on the mode probability for each driving mode and the deviation calculated for each driving mode.

7 Claims, 6 Drawing Sheets

SYSTEM FOR DETECTING ABNORMAL DRIVING BEHAVIOR

CROSS REFERENCE TO RELATED APPLICATIONS

This application is based on and claims the benefit of priority from Japanese Patent Application 2013-052115 filed on Mar. 14, 2013, the disclosure of which is incorporated in its entirety herein by reference.

TECHNICAL FIELD

The present disclosure relates to systems for detecting, based on the running conditions of a vehicle or the driver's operating conditions of the vehicle, driver's abnormal driving behaviors.

BACKGROUND

There are urgent requirements to avoid vehicle accidents due to driver's errors in order to improve traffic safety. In view of these requirements, there are known technologies for detecting, based on observed values indicative representing the running conditions of a vehicle or the driver's operating conditions of the vehicle, driver's abnormal behaviors, one of which is disclosed in, for example, Japanese Patent Application Publication No. 2009-154675.

The technology disclosed in the Patent Publication uses normal behavior models and abnormal behavior models. Each of the normal behavior models represents a model obtained by modelling driver's driving behaviors when they are normal. Each of the abnormal behavior models represents a model obtained by modelling driver's driving behaviors when they are abnormal, which include, for example, a driver's driving behavior when the driver is dozing off.

Specifically, the technology cyclically collects observed values of the running conditions of a vehicle or the driver's operating conditions of the vehicle. Then, the technology estimates, based on the previously obtained observed values and the normal behavior models, a current observed value as a first estimation value, and estimates, based on the previously obtained observed values and the abnormal behavior models, a current observed value as a second estimation value.

Then, the technology determines whether a current observed value, which is actually observed, is closer to one of the first estimation value and the second estimation value than to the other thereof, and determines whether the driver's driving behaviors are normal or abnormal.

SUMMARY

In the aforementioned technology disclosed in the Patent Publication, in order to prepare the abnormal behavior models, it is necessary to collect observed values of the running conditions of a vehicle or the driver's operating conditions of the vehicle while a driver is abnormally operating the vehicle. However, it may be difficult to collect these observed values.

In addition, because there are numerous variations of driver's abnormal driving behaviors, it may be difficult to prepare the abnormal behavior models under consideration of all of the variations of driver's abnormal driving behaviors, resulting in difficulty determining whether the driver's driving behaviors are normal or abnormal at a high accuracy.

In view of the circumstances set forth above, one aspect of the present disclosure seeks to provide systems for detecting abnormal driving behaviors, which are capable of addressing the aforementioned problems.

Specifically, an alternative aspect of the present disclosure aims to provide such systems, which are capable of detecting driver's abnormal driving behaviors without using such abnormal behavior models.

According to a first exemplary aspect of the present disclosure, there is provided an abnormal driving behavior detection system for a vehicle. The system includes an obtainer that repeatedly obtains an observed value indicative of at least one of a running condition of the vehicle and a driver's driving operation of the vehicle. The system includes a mode-probability calculator that calculates, each time an observed value is obtained at a given obtaining timing as a target obtained value, a mode probability for each of a plurality of driving modes as a function of one or more previous observed values previously obtained before the target obtained value. Each of the plurality of driving modes is defined by modelling a group of normal driving behaviors. The mode probability for each of the plurality of driving modes represents a probability that a target driving mode at the given obtaining timing corresponds to a corresponding one of the plurality of driving modes. The system includes a deviation calculator that obtains, for comparison with the target obtained value, a predicted observed value for each of the plurality of driving modes using a driver's normal behavior model defined for a corresponding one of the plurality of driving modes, and calculates a deviation of the target observed value from the predicted observed value for each of the plurality of driving modes. The system includes an abnormality determiner that determines whether there is at least one driver's abnormal behavior based on the mode probability for each of the plurality of driving modes and the deviation calculated for each of the plurality of driving modes.

According to a second exemplary aspect of the present disclosure, there is provided a program product usable for an abnormal driving behavior detection system for a vehicle. The program product includes a non-transitory computer-readable medium; and a set of computer program instructions embedded in the computer-readable medium. The instructions causes a computer of a security system to:

repeatedly obtain an observed value indicative of at least one of a running condition of the vehicle and a driver's driving operation of the vehicle;

calculate, each time an observed value is obtained at a given obtaining timing as a target obtained value, a mode probability for each of a plurality of driving modes as a function of one or more previous observed values previously obtained before the target obtained value, each of the plurality of driving modes being defined by modelling a group of normal driving behaviors, the mode probability for each of the plurality of driving modes representing a probability that a target driving mode at the given obtaining timing corresponds to a corresponding one of the plurality of driving modes;

obtain, for comparison with the target obtained value, a predicted observed value for each of the plurality of driving modes using a driver's normal behavior model defined for a corresponding one of the plurality of driving modes;

calculate a deviation of the target observed value from the predicted observed value for each of the plurality of driving modes; and determine whether there is at least one driver's abnormal behavior based on the mode probability for each of the plurality of driving modes and the deviation calculated for each of the plurality of driving modes.

The configuration of each of the first and second exemplary aspects of the present disclosures determines whether there is at least one driver's abnormal behavior based on the mode probability for each of the plurality of driving modes and the deviation calculated for each of the plurality of driving modes. Each of the plurality of driving modes is defined by modelling a group of normal driving behaviors. The mode probability for each of the plurality of driving modes represents a probability that a target driving mode at the given obtaining timing corresponds to a corresponding one of the plurality of driving modes. Thus, it is possible to determine whether there is at least one driver's abnormal behavior without using abnormal behavior models each of which is obtained by modelling driver's driving behaviors when they are abnormal. Thus, the determination of there is at least one driver's abnormal behavior can be performed with a higher accuracy and a simpler procedure.

The above and/or other features, and/or advantages of various aspects of the present disclosure will be further appreciated in view of the following description in conjunction with the accompanying drawings. Various aspects of the present disclosure can include and/or exclude different features, and/or advantages where applicable. In addition, various aspects of the present disclosure can combine one or more feature of other embodiments where applicable. The descriptions of features, and/or advantages of particular embodiments should not be construed as limiting other embodiments or the claims.

BRIEF DESCRIPTION OF THE DRAWINGS

Other aspects of the present disclosure will become apparent from the following description of embodiments with reference to the accompanying drawings in which.

two sequences of observed values when a first driving mode is switched to a second driving mode;

two sequences of predicted values corresponding to the observed values when the first driving mode is switched to the second driving mode; and a normal range for the first driving mode.

DETAILED DESCRIPTION OF EMBODIMENT

An embodiment of the present disclosure will be described hereinafter with reference to the accompanying drawings.

Figure 1:
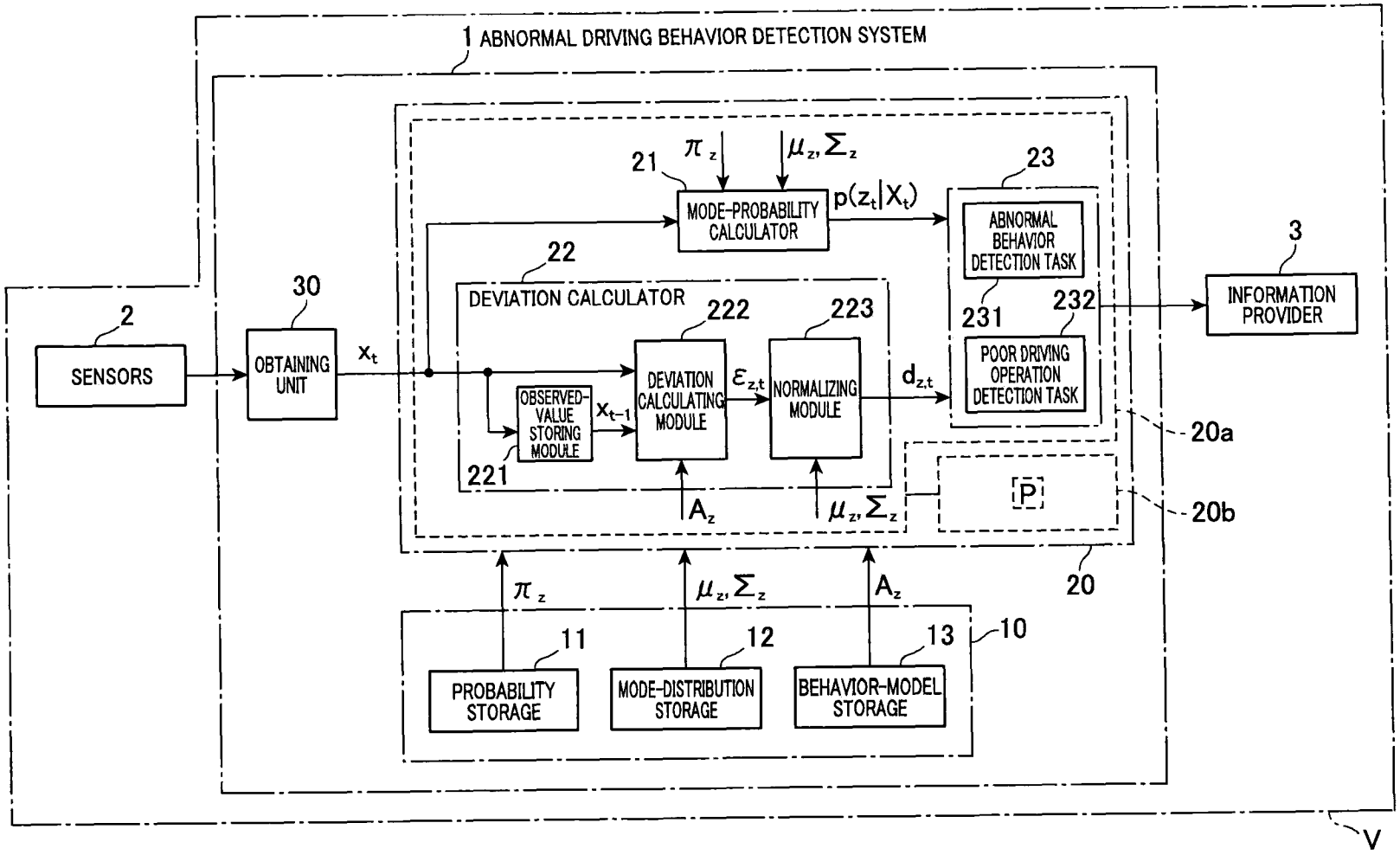
FIG. 1 is a block diagram schematically illustrating an example of the overall configuration of a driving support system SS according to an embodiment of the present disclosure.

Referring to FIG. 1, there is illustrated a driving support system SS to which this embodiment of the present disclosure is applied. The driving support system SS is installed in a motor vehicle, referred to simply as a vehicle, V. The driving support system SS includes sensors 2 installed in the vehicle V, an abnormal driving behavior detection system 1, and an information provider 3.

Some of the sensors 2, which serves as, for example, an obtainer, are operative to detect the running conditions of the vehicle V, and some of the sensors 2, which serves as, for example, an obtainer, are operative to detect the driver's operating conditions of the vehicle V. The running conditions of the vehicle V detectable by some of the sensors 2 include, for example, the speed of the vehicle V, the longitudinal and horizontal accelerations of the vehicle V, the relative speed between the vehicle V and a forward vehicle, and so on. The driver's operating conditions of the vehicle V include, for example, the rate of change of the accelerator operating member, such as the accelerator pedal, of the vehicle V, the pressure of the brake master cylinder of the vehicle V, the steering angle of the vehicle V, and so on. Because the sensors 2 for detecting the aforementioned running conditions and the driver's operating conditions of the vehicle V are known, the additional descriptions of these are omitted.

The abnormal driving behavior detection system 1 is communicably connected to the sensors 2 and operative to determine whether there is at least one driver's abnormal behavior as a function of the measured results of the sensors 2.

The information provider 3 is equipped with, for example, a visible-information output device and an audible-information output device. Specifically, the information provider 3 is operative to receive the determined results of the abnormal driving behavior detection system 1, and convert the determined results into at least one of visible information, such as text information, geometry information, light information, or the like, and audible information, such as sound information, alarm information, or the like. Then, the information provider 3 is operative to provide at least one of the visible information and the audible information to an occupant, such as the driver, via a corresponding at least one of the visible-information output device and the audible-information output device.

The abnormal driving behavior detection system 1 is configured to perform various operations based on an autoregressive hidden Markov model (AR-HMM) as one of models for observed sequence data.

First, let us describe parameters used by an AR-HMM.

Figure 2A:
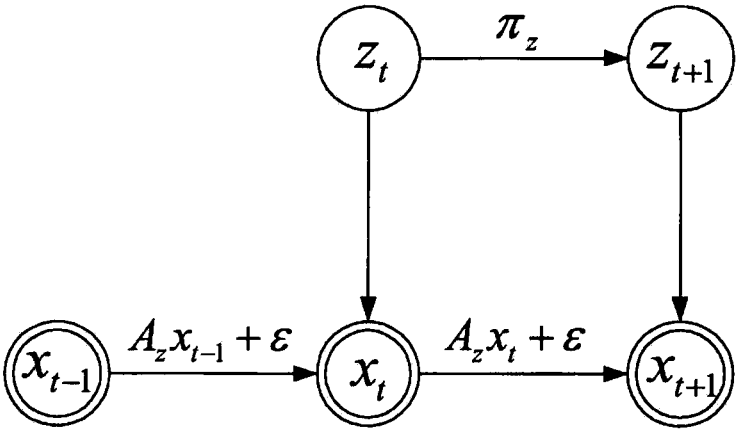
FIG. 2A is a schematic view of an AR-HMM that expresses a model of driver's driving behaviors according to the embodiment.

FIG. 2A is a schematic view of an AR-HMM that expresses a model of driver's driving behaviors. In FIG. 2A, reference character t represents a current time, reference character $x_t$ represents an observed value at the current time t, i.e. a measured value of a corresponding sensor 2 at the time t, and reference character $z_t$ represents a state variable indicative of a corresponding one of modes, i.e. driving modes, indicative of a driver's driving behavior at the current time t. A state variable $z_t$ is in a 'hidden' state that is not observed directly. For this reason, a sequence $Z_t$ of hidden state variables $z_1$, $z_2, \ldots, z_t$, which is given by, $Z_t=\{z_1, z_2, \ldots, z_t\}$ is predicted based on a plurality of sequences $X_t$ of observed values $x_1, x_2, \ldots, x_t$, each of which is given by $X_t=\{x_1, x_2, \ldots, x_t\}$, measured by the corresponding sensors 2.

Hereinafter, each of individual state variables $z_1, z_2, \ldots, z_t$ are categorized into a given number of driving modes M1 to Mm (m is an integer not less than 2). That is, a given state variable z in the sequence $Z_t$ of the state variables $z_1, z_2, \ldots, z_t$ belongs to any one of the driving modes M1 to Mm. Because these driving modes M1 to Mm are not directly observed, they are manipulated as hidden state variables. Specifically, normal driving behaviors and normal driving operations observed at various situations are grouped to be modeled as the driving modes M1 to Mm. In each of the driving modes M1 to Mm, observed normal driving behaviors and observed normal driving operations contained therein show a similar driving-behavior or driving-operation tendency. In other words, time-series behaviors of each piece of data observed by the sensors 2 are categorized into plural groups, and each of the driving modes M1 to Mm shows an index of a corresponding one of the groups. For example, right-hand turn or left-hand turn as a normal driving operation can be divided into plural driving steps, such as depression of the brake pedal and slight steering of the steering wheel, and the driving modes M1 to Mm conceptually show the indexes of the divided driving steps, respectively.

In addition, in this embodiment, driving operations for example show actual operations of operation devices of the vehicle V, such as the accelerator pedal, the brake pedal, and the steering wheel. Driving behaviors for example show, in addition to observed driving operations, observed values of the operating conditions of the vehicle V, such as the vehicle speed and the acceleration of the vehicle V.

That is, the sequence of state variables $z_1, z_2, \ldots, z_t$, each of which corresponds to one of the driving modes M1 to Mm, shows a corresponding driving behavior and/or a driving operation. Thus, the state variables $z_1, z_2, \ldots, z_t$, each of which corresponds to one of the driving modes M1 to Mm, constitute driver's primitive driving factors of a corresponding driving behavior and/or a driving operation.

As illustrated in FIG. 2A, autoregressive models for each of the driving-mode groups M1 to Mm and an observed-value sequence $X_t$ can be expressed by the following equations (1) to (3):

$$x_{t+1}=A_z x_t+\epsilon \tag{1}$$

$$\epsilon \sim N(\epsilon|\mu_z,\Sigma_z) \tag{2}$$

$$z_{t+1}\sim\pi_z \tag{3}$$

where:

$A_z$ represents a driving-behavior model, i.e. a normal driving-behavior model, that is a model in which average driving behaviors during normal driving, i.e. without any abnormal driving, in a corresponding one of the driving modes M1 to Mm;

$\epsilon$ represents noise following a Gaussian distribution, i.e. a normal distribution of a corresponding one of the driving-mode groups M1 to Mm;

$\mu_z$ represents an average of a Gaussian distribution of a corresponding one of the driving modes M1 to Mm;

$\Sigma_z$ represents a variance of a Gaussian distribution of a corresponding one of the driving modes M1 to Mm, the average $\mu_z$ and the variance $\Sigma_z$ will be referred to as mode-distribution parameters defining a Gaussian distribution;

$N(\epsilon|\mu_z, \Sigma_z)$ represents a Gaussian distribution of noises $\epsilon$ defined based on the mode-distribution parameters $\mu_z$ and $\Sigma_z$; and $\pi_z$ represents a mode transition probability that is a transition probability between adjacent driving-mode groups.

Note that the left-hand side of each of the equations (2) and (3) with respect to the character ~ represents sampled values from a distribution defined by the right-hand side of a corresponding one of the equations (2) and (3).

Figure 2B:
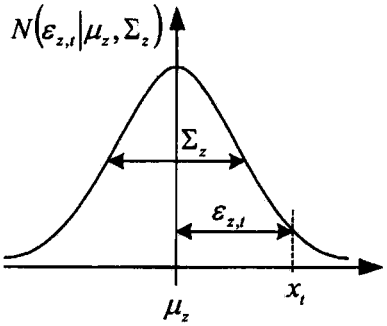
FIG. 2B is a graph schematically illustrating parameters of a Gaussian distribution according to the embodiment.

These equations (1) to (3) can be established on the conditions that:

the distribution of observed values in each of the driving modes M1 to Mm follows a Gaussian distribution; and the average and the variance, which are parameters that describe a probability distribution, i.e. a Gaussian distribution, of observed values observed in a driving mode, are respectively expressed by $\mu_z$ and $\Sigma_z$ (see FIG. 2B).

The abnormal driving behavior detection system 1 is configured to learn, i.e. train, and determine, as learned data, values of these parameters $A_z$, $\pi_z$, $\mu_z$, and $\Sigma_z$ using: observed values measured by the sensors 2 during normal driving, i.e. without any abnormal driving; and a known learning algorithm, such as a forward-backward algorithm.

Schematically, the abnormal driving behavior detection system 1 allocates one of the driving modes to each piece of the learned data, and calculates, based on pieces of the learned data to which the same driving modes are allocated, the mode-distribution parameters $\mu_z$ and $\Sigma_z$ of the distribution of each of the driving modes. This permits the noise $\epsilon$ for each of the driving modes to be obtained in accordance with the equation (2), and therefore, the parameter, i.e. the driving-behavior model parameter, $A_z$ for each of the driving modes can be obtained in accordance with the equation (1).

In addition, the abnormal driving behavior detection system 1 predicts the sequence of each driving mode, and counts, based on the predicted sequence of each driving mode, the number of transitions between the individual driving modes. Then, the driving behavior detection system 1 calculates, based on the results of the count operation, the mode transition probability $\pi_z$.

Particularly, the abnormal driving behavior detection system 1 learns and determines values of these parameters $A_z$, $\pi_z$, $\mu_z$, and $\Sigma_z$ uses a known learning algorithm based on Beta Process Autoregressive Hidden Markov Model (BP-AR-HMM). This makes it possible to automatically determine these parameters $A_z$, $\pi_z$, $\mu_z$, and $\Sigma_z$, and the number of the driving modes in addition thereto).

How to specifically determine in detail these parameters $A_z$, $\pi_z$, $\mu_z$, and $\Sigma_z$, and the number of the driving modes using BP-AR-HMM is described in, for example, E. B. Fox. E. B. Sudderth, M. I. Jordan, and A. S. Willsky, "*Sharing features among dynamical systems with beta processes*", Advances in Neutral Information Processing Systems, Vol. 22, pp. 549-557 (2009). Thus, additional descriptions thereabout are omitted.

Next, let us describe an example of the structure of the detection system 1 with reference to FIG. 1.

Referring to FIG. 1, the detection system 1 includes an observed-value obtaining unit, referred to as an obtaining unit, 30, a storage unit 10, and a processing unit 20 communicably coupled to the obtaining unit 30 and the storage unit 10.

The obtaining unit 30 is configured to cyclically obtain a measured value of each of the sensors 2 as an observed value $x_t$, and cyclically send an observed value $x_t$ of each of the sensors 2 to the processing unit 20.

The storage unit 10 has stored therein these parameters defining the driving modes M1 to Mm.

The processing unit 20 is configured to perform various operations including an operation that determines, as a function of the parameters stored in the storage unit 10 and the plurality of sequences $X_t$ of observed values $x_1, x_2, \ldots, x_t$ obtained from the sensors 2, whether there are driver's abnormal driving behaviors and/or driver's poor driving operations.

For example, a poor driving operation is an operation of the vehicle V which is performed poorly by a driver because the driver has a low level of skill in that operation, for example, parking in a very confined space. An abnormal driving operation is, for example, an operation which no driver would normally attempt or carry out.

Specifically, the storage unit 10 is comprised of a mode-transition probability storage 11, a mode-distribution storage 12, and a behavior-model storage 13.

The mode-transition probability storage 11 is operative to store therein the mode transition probability $\pi_z$.

The mode-distribution storage 12 is operative to store therein the mode-distribution parameters $\mu_z$ and $\Sigma_z$ for each of the driving modes M1 to Mm.

The behavior-model storage 13 is operative to store therein the behavior model $A_z$ for each of the driving modes M1 to Mm.

The processing unit 20 is comprised of a mode-probability calculator 21, a deviation calculator 22, and a detector 23 operatively connected to the mode-probability calculator 21 and the deviation calculator 22.

The mode-probability calculator 21 is operative to calculate a mode probability $p(z_t|X_t)$ for each of the driving modes M1 to Mm based on a target sequence $X_t$ of observed values $x_1, x_2, \ldots, x_t$ that have been obtained up to the current time t; the mode transition probability $\pi_z$ stored in the probability storage 11; and the mode-distribution parameters $\mu_z$ and $\Sigma_z$ for a corresponding one of the driving modes M1 to Mm stored in the mode-distribution storage 12.

The deviation calculator 22 is operative to calculate a normalized deviation $d_{z,t}$ for each of the driving modes M1 to Mm as a function of: the behavior model $A_z$ for a corresponding one of the driving-mode groups M1 to Mm stored in the behavior-model storage 13; the mode-distribution parameters $\mu_z$ and $\Sigma_z$ for a corresponding one of the driving modes M1 to Mm; and the target sequence $X_t$ of observed values $x_1, x_2, \ldots, x_t$.

The normalized deviation $d_{z,t}$, for each of the driving modes M1 to Mm shows a deviation of the target sequence $X_t$ of observed values $x_1, x_2, \ldots, x_t$ from a corresponding one of the driving modes M1 to Mm.

The detector 23, which serves as, for example, an abnormality determiner, is operative to determine whether there is at least one driver's abnormal behavior as a function of: the mode probability $p(z_t|X_t)$ for each of the driving modes M1 to Mm; and the normalized deviation $d_{z,t}$ for a corresponding one of the driving modes M1 to Mm.

The mode-probability calculator 21, the deviation calculator 22, and the detector 23 are configured to perform these operations for each of the plurality of sequences $X_t$ of observed values $x_1, x_2, \ldots, x_t$.

The processing unit 20 is designed as, for example, a microcomputer unit (programmed logic unit) comprised of at least a CPU 20*a* and a storage 20*b* (which is, for example, a non-transitory computer-readable storage medium) including at least one of ROM and RAM. The functional blocks illustrated in FIG. 1 can be implemented by running, by the CPU 20*a*, at least one program P stored in the storage 20*b*. As another example, the processing unit 20 can be designed as a hardware circuit comprised of hardware units respectively corresponding to the functional blocks illustrated in FIG. 1, or as a hardware/software hybrid circuit, some of these functional blocks being implemented by some hardware units, and the remaining functional blocks being implemented by software to be run by the CPU 20*a*.

Next, further descriptions of each of the mode-probability calculator 21, the deviation calculator 22, and the detector 23 will be provided hereinafter.

When receiving a first observed value $x_1$ of a target sequence $X_t$, the mode-probability calculator 21 calculates, based on the mode-distribution parameters $\mu_z$ and $\Sigma_z$ for each of the driving modes M1 to Mm, a probability $p(x_1|z)$ of the first observed value $x_1$ being generated in each of the driving modes M1 to Mm. Then, the mode-probability calculator 21 sets the probability $p(x_1|z)$ for each of the driving modes M1 to Mm as an initial value $p(z_1|X_1)$ of the mode probability $p(z_t|X_t)$ for a corresponding one of the driving modes M1 to Mm.

When receiving a next, i.e. a second, observed value $x_2$ of the target sequence $X_t$, the mode-probability calculator 21 calculates, based on the mode-distribution parameters $\mu_z$ and $\Sigma_z$ for each of the driving modes M1 to Mm, a probability $p(x_2|z)$ of the second observed value $x_2$ being generated in a corresponding one of the driving modes M1 to Mm.

Then, the mode-probability calculator 21 estimates, for each of the driving modes M1 to Mm, a probability P(z) of a corresponding one of the driving modes M1 to Mm at the obtaining timing of the second observed value $x_2$ based on: the mode transition probability $\pi_z$; and the initial value $p(z_1|X_1)$ of the mode probability $p(z_t|X_t)$ for a corresponding one of the driving modes M1 to Mm. Thereafter, the mode-probability calculator 21 obtains, for each of the driving modes M1 to Mm, a mode probability $p(z_2|X_2)$ for a corresponding one of the driving modes M1 to Mm using: Bayesian estimation; the probability $p(x_2|z)$ as a likelihood; and the probability P(z) as a prior probability.

Specifically, each time the mode-probability calculator 21 receives an observed value $x_t$ of a target sequence $X_t$ at a current sampling cycle t, the mode-probability calculator 21 is configured to:

calculate, based on the mode-distribution parameters $\mu_z$ and $\Sigma_z$ for each of the driving modes M1 to Mm, a probability $p(x_t|z)$ of the second observed value $x_t$ being generated in a corresponding one of the driving modes M1 to Mm;

estimate, for each of the driving-mode groups M1 to Mm, a probability P(z) that there is a corresponding one of the driving modes M1 to Mm at the current sampling cycle t i.e. the obtaining timing of the observed value $x_t$, based on the mode transition probability $\pi_z$, and the previous mode probability $p(z_{t-1}|X_{t-1})$ at the previous sampling cycle (t−1) for a corresponding one of the driving modes M1 to Mm; and obtain, for each of the driving modes M1 to Mm, a mode probability $p(z_t|X_t)$ for a corresponding one of the driving modes M1 to Mm using: Bayesian estimation; the probability $p(x_t|z)$ as a likelihood; and the probability P(z) as a prior probability.

The mode probability $p(z_t|X_t)$ for each of the driving modes M1 to Mm has:

a first characteristic that, when the driver's driving operations are currently carried out in one of the driving modes M1 to Mm, the mode probability $p(z_t|X_t)$ for the one of the driving modes M1 to Mm, i.e. a current driving mode, becomes a value significantly higher than a value of the mode probability $p(z_t|X_t)$ for each of the remaining driving modes; and a second characteristic that, when the driver's driving operations are not carried out in any of the driving modes M1 to Mm, there are no significantly high values of the respective mode probabilities $p(z_t|X_t)$ for the driving modes M1 to Mm.

More specifically, when driver's driving operations are not carried out in any of the driving modes M1 to Mm, the mode probabilities $p(z_t|X_t)$ for all the driving modes M1 to Mm take on intermediate values between the significantly high value of the mode probability $p(z_t|X_t)$ for the current driving mode and one of the values of the mode probabilities $p(z_t|X_t)$ for the remaining driving modes.

The deviation calculator 22 is, for example, comprised of an observed-value storing module 221, a deviation calculating module 222, and a normalizing module 223. The observed-value storing module 221 is simply illustrated in FIG. 1 as STORAGE.

The observed-value storing module 221 is operative to store therein an observed value $x_{t-1}$ of a target sequence $X_{t-1}$ at a previous sampling cycle t−1 for each of the driving modes M1 to Mm.

The deviation calculating module 222 is operative to:

predict an observed value $x_t'$ for each of the driving modes M1 to Mm based on the observed value $x_{t-1}$ for a corresponding one of the driving modes M1 to Mm and the behavior model $A_z$ for a corresponding one of the driving modes M1 to Mm; and calculate a deviation $\epsilon_{z,t}$ of the predicted observed value $x_t'$ for each of the driving modes M1 to Mm from an observed value $x_t$ measured at the current sampling cycle t for a corresponding one of the driving modes M1 to Mm.

The normalizing module 223 is operative to normalize the deviation $\epsilon_{z,t}$ for each of the driving modes M1 to Mm using a probability of an observed value $x_t$ having the deviation $\epsilon_{z,t}$ being generated, thus obtaining a normalized deviation $d_{z,t}$ for each of the driving modes M1 to Mm.

Specifically, the deviation calculating module 222 calculates the deviation $\epsilon_{z,t}$ in accordance with the following equation (4), and the normalizing module 223 calculates the normalized deviation $d_{z,t}$ in accordance with the following equation (5):

$$\varepsilon_{z,t} = x_t' - A_z x_{t-1} \tag{4}$$

$$d_{z,t} = \frac{1}{N(\varepsilon_{z,t} \mid \mu_z, \Sigma_z)} \tag{5}$$

where $N(\epsilon_{z,t}|\mu_z, \Sigma_z)$ represents a probability of the observed value $x_t$ having the deviation $\epsilon_{z,t}$ being generated in each of the driving modes M1 to Mm.

That is, the more the deviation $\epsilon_{z,t}$ for each of the driving modes M1 to Mm deviates from the average $\mu_z$ of a corresponding one of the driving modes M1 to Mm, the more the probability $N(\epsilon_{z,t}|\mu_z, \Sigma_z)$ for a corresponding one of the driving modes M1 to Mm is reduced.

Thus, using the equation (5), the normalizing module 223 calculates the normalized deviation $d_{z,t}$ for each of the driving modes M1 to Mm as the inverse of the probability $N(\epsilon_{z,t}|\mu_z, \Sigma_z)$ for a corresponding one of the driving modes M1 to Mm. This is because, the more the deviation $\epsilon_{z,t}$ for each of the driving modes M1 to Mm deviates from the average $\mu_z$ of a corresponding one of the driving modes M1 to Mm, the more the normalized deviation $d_{z,t}$ for a corresponding one of the driving modes M1 to Mm increases.

Hereinafter, the normalized deviation $d_{z,t}$ will be referred to simply as a deviation $d_{z,t}$.

Note that the deviation $d_{z,t}$ for each of the driving modes M1 to Mm is obtained by the deviation calculator 222 for every sampling cycle, and the obtained deviations $d_{z,t}$ for the respective sampling cycles are stored in, for example, the storage 20*b*.

The detector 23 is configured to perform an abnormal behavior detection task 231 and a poor driving operation detection task 232.

First, the abnormal behavior detection task 231 will be described.

The detector 23 runs the abnormal behavior detection task 231 when the mode probability $p(z_t|X_t)$ and the deviation $d_{z,t}$ for each of the driving modes M1 to Mm are calculated based on an observed value $x_t$ of a target sequence $X_t$ measured at a current sampling cycle t.

Figure 3:
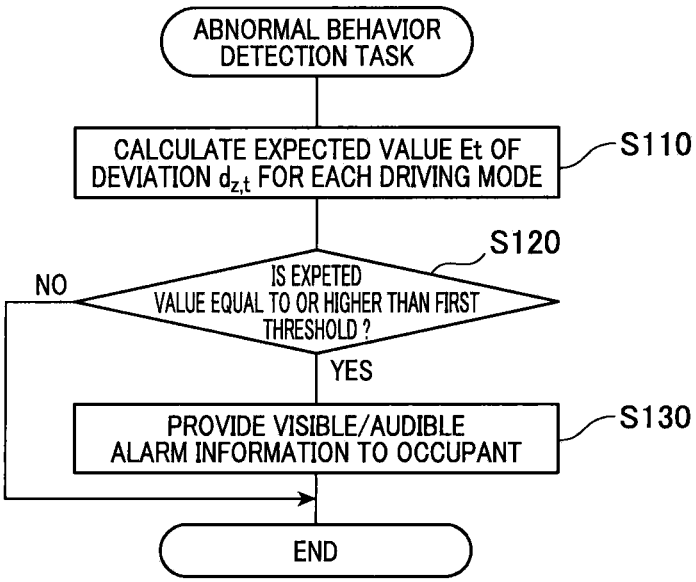
FIG. 3 is a flowchart schematically illustrating an example of an abnormal behavior detection task carried out by a detector illustrated in FIG. 1 according to the embodiment.
Figure 4:
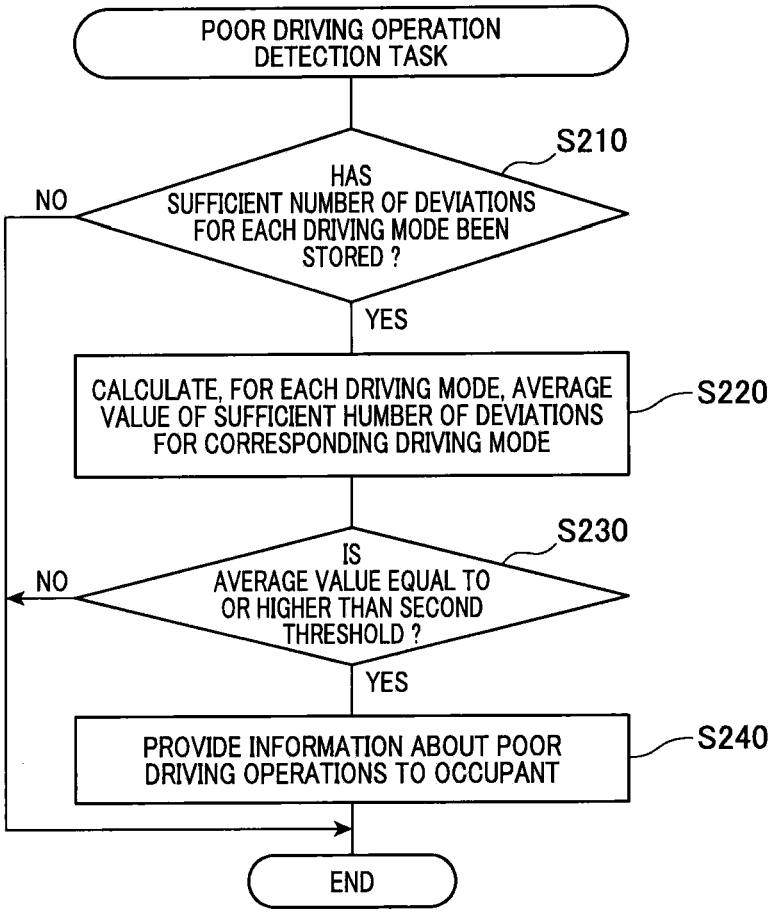
FIG. 4 is a flowchart schematically illustrating an example of a poor driving operation detection task carried out by the detector illustrated in FIG. 1 according to the embodiment.

The abnormal behavior detection task 231 run by the detector 23 performs a weighted addition of the deviation $d_{z,t}$ for each of the driving modes M1 to Mm using, as a weight coefficient, the mode probability $p(z_t|X_t)$ for a corresponding one of the driving modes M1 to Mm in accordance with the following equation (6), thus calculating an expected value $E_t$ of the deviation $d_{z,t}$ for each of the driving modes M1 to Mm in step S110 of FIG. 3:

$$E_t = \sum_z d_{z,t} p(z_t \mid X_t) \tag{6}$$

When the driver's driving operations follow one of the driving modes M1 to Mm as a current driving mode, the mode probability $p(z_t|X_t)$ for the current driving mode becomes a value significantly higher than a value of the mode probability $p(z_t|X_t)$ for each of the remaining driving modes. In contrast, the deviation $d_{z,t}$ for the current driving mode is a lower value, and the deviation $d_{z,t}$ for each of the remaining driving modes is a higher value. Thus, the expected value $E_t$ of the deviation $d_{z,t}$ for the current driving mode, which is obtained based on multiplication of the corresponding mode probability $p(z_t|X_t)$ and deviation $d_{z,t}$, is kept to be a lower value.

On the other hand, when driver's driving operations do not follow any of the driving modes M1 to Mm, there are none of driving modes M1 to Mm whose mode probabilities $p(z_t|X_t)$ have a significantly high value. That is, the mode probabilities $p(z_t|X_t)$ for all the driving modes M1 to Mm take on intermediate values between the significantly high value of the mode probability $p(z_t|X_t)$ for the current driving mode and one of the values of the mode probabilities $p(z_t|X_t)$ for the remaining driving modes. This results in the expected value $E_t$ of the deviation $d_{z,t}$ for each of the driving modes M1 to Mm being a higher value.

Following the operation in step S110, the abnormal behavior detection task 231 determines whether the expected value $E_t$ of the deviation $d_{z,t}$ for each of the driving modes M1 to Mm calculated in step S110 is equal to or higher than a first threshold in step S120. The first threshold is previously set to be sufficiently lower than the higher value of the expected value $E_t$ of the deviation $d_{z,t}$ for each of the driving modes M1 to Mm in step S120.

Upon determination that the expected value $E_t$ of the deviation $d_{z,t}$ for each of the driving modes M1 to Mm calculated in step S110 is lower than the first threshold (NO in step S120), the abnormal behavior detection task 231 determines that there are no driver's abnormal behaviors, and therefore, the abnormal behavior detection task 231 is terminated.

Otherwise, upon determination that the expected value $E_t$ of the deviation $d_{z,t}$ for each of the driving modes M1 to Mm calculated in step S110 is equal to or higher than the first threshold (YES in step S120), the abnormal behavior detection task 231 determines that there is at least one driver's abnormal behavior. Then, the abnormal behavior detection task 231 sends the determined result indicative of the detection of at least one driver's abnormal behavior to the information provider 3, thus causing the information provider 3 to provide visible and/or audible alarm information to an occupant, such as the driver, in step S130. After the operation in step S130, the abnormal behavior detection task 231 is terminated.

Next, the poor driving operation detection task 232 will be described.

The detector 23 runs the poor driving operation detection task 232 each time a preset number of deviations $d_{z,t}$ which corresponds to the same number of sampling cycles, for each of the driving modes M1 to Mm has been stored in the storage 20*b* (see YES in step S210). In other words, the detector 23 does not run the poor driving operation detection task 232 unless the preset number of deviations $d_{z,t}$ for each of the driving modes M1 to Mm has been stored in the storage 20*b* (see NO in step S210). For example, once the preset number of deviations $d_{z,t}$ for each of the driving modes M1 to Mm stored in the storage 20*b* is used for the poor driving operation detection task, they can be deleted from the storage 20*b* or can be held therein.

The preset number of deviations $d_{z,t}$ for each of the driving modes M1 to Mm is determined such that an average value of the preset number of deviations $d_{z,t}$ for each of the driving modes M1 to Mm, which will be obtained in the poor driving operation detection task 232, becomes a statistically reliable and sufficient value.

After affirmative determination in step S210, the poor driving operation detection task 232 calculates, for each of the driving modes M1 to Mm, an average value of the preset number of deviations $d_{z,t}$ for a corresponding one of the driving modes M1 to Mm, which are stored in the storage 20*b*, in step S220; the average value will be referred to as a mode-to-mode averaged distribution.

Following the operation in step S220, the poor driving operation detection task 232 determines whether there is at least one driving mode whose mode-to-mode averaged distribution calculated in step S220 is equal to or higher than a second threshold in step S230.

Upon determination that there are no driving mode whose mode-to-mode averaged distributions calculated in step S220 are lower than the second threshold (NO in step S230), the poor driving operation detection task 232 is terminated.

Otherwise, upon determination that there is at least one driving mode whose mode-to-mode averaged distribution calculated in step S220 is equal to or higher than the second threshold (YES in step S230), the poor driving operation detection task 232 extracts the driver's driving operations included in the at least one driving mode as poor driving operations in step S240. Then, the poor driving operation detection task 232 sends the determined result indicative of the extracted poor driving operations to the information provider 3, thus causing the information provider 3 to provide visible and/or audible information about the extracted poor driving operations to an occupant, such as the driver, in step S240. After the operation in step S130, the poor driving operation detection task 232 is terminated.

Next, overall operations of the abnormal driving behavior detection system 1 will be described hereinafter assuming that, in order to easily understand them, the driving modes M1 to Mm are first and second driving modes M1 and M2, i.e. m=2. This results in the distribution of each of the first and second driving modes M1 and M2 being expressed based on the mode-distribution parameters $\mu_z$ and $\Sigma_z$ for a corresponding one of the first and second driving modes M1 and M2.

Figure 5A:
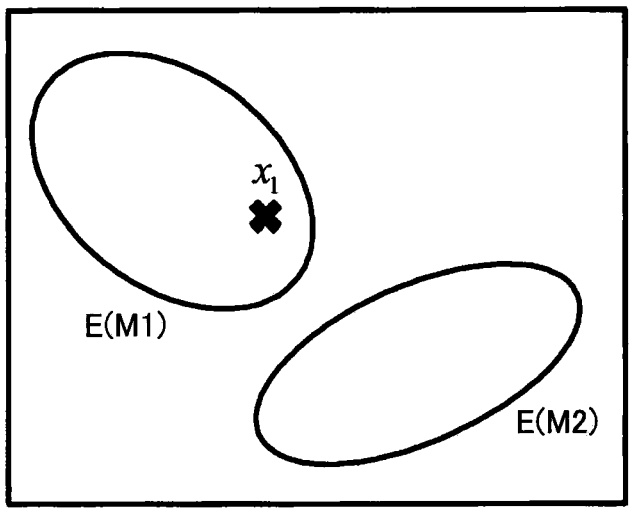
FIG. 5A is a view schematically illustrating a relationship between a first observed value and each of the first and second driving modes according to the embodiment.

Referring to FIG. 5A, a first observed value $x_1$ of a target sequence $X_t$ is obtained by the processing unit 20 at a current time t=1. In FIG. 5A, an ellipse E(M1) shows a distribution of observed values obtained in the first driving mode M1; the distribution is defined based on the corresponding mode-distribution parameters $\mu_z$(M1) and $\Sigma_z$ (M1). In addition, an ellipse E(M2) shows a distribution of observed values obtained in the second driving mode M2; the distribution is defined based on the corresponding mode-distribution parameters $\mu_z$(M2) and $\Sigma_z$(M2).

In this assumption, let us consider whether the first observed value $x_1$ is generated in the distribution of the first driving mode M1 or in that of the second driving mode M2.

As described above, the probability $p(x_1|M1)$ shows a probability of the first observed value $x_1$ being generated in the first driving mode M1, and the probability $p(x_1|M2)$ shows a probability of the first observed value $x_1$ being generated in the second driving mode M2. In a case illustrated in FIG. 5A, the probability $p(x_1|M1)$ is higher than the probability $p(x_1|M2)$, so that the hidden state, i.e. the driving mode, corresponding to the first observed value $x_1$ is likely to be the first driving mode M1.

Figure 5B:
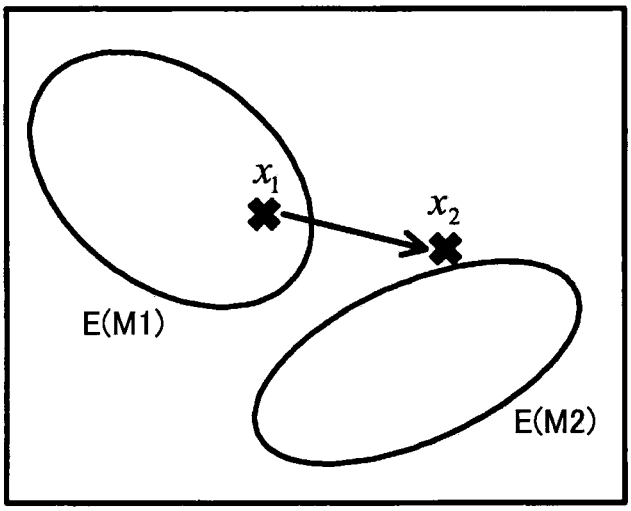
FIG. 5B is a view schematically illustrating a relationship between each of the first observed value and a second observed value and the first and second driving modes according to the embodiment.

Next, referring to FIG. 5B, a second observed value $x_2$ of a target sequence $X_t$ is obtained by the processing unit 20 at a current time t=2. Like the case t=1, let us consider whether the second observed value $x_2$ is generated in the distribution of the first driving mode M1 or in that of the second driving mode M2. In a case illustrated in FIG. 5B, the probability $p(x_2|M1)$ is lower than the probability $p(x_2|M2)$, so that there is a high possibility that the hidden state, i.e. the driving mode, corresponding to the second observed value $x_2$ is the second driving mode M2.

At that time, the abnormal driving behavior detection system 1 is configured to obtain the mode probability $p(z_t|X_t)$ for each of the first and second driving modes M1 and M2 based on the mode transition probability $\pi_z$ that is transition probability between the first and second driving modes M1 and M2. Specifically, in a case where the mode transition probability $\pi_z$ has a lower value, which shows that the second observed value $x_2$ is likely to be kept within the first driving mode M1, even if the probability $p(x_2|M2)$ is a higher value, the mode probability $p(z_t|X_t)$ for the second driving mode M2 is kept low. Thus, when the series observed values $x_1$ and $x_2$ illustrated in FIG. 5B are observed, there is a high possibility that the abnormal driving behavior detection system 1 determines that series hidden-states estimated by the series observed values $x_1$ and $x_2$ do not correspond to the first and second driving modes M1 and M2, but each correspond to the first driving mode M1.

Figure 6A:
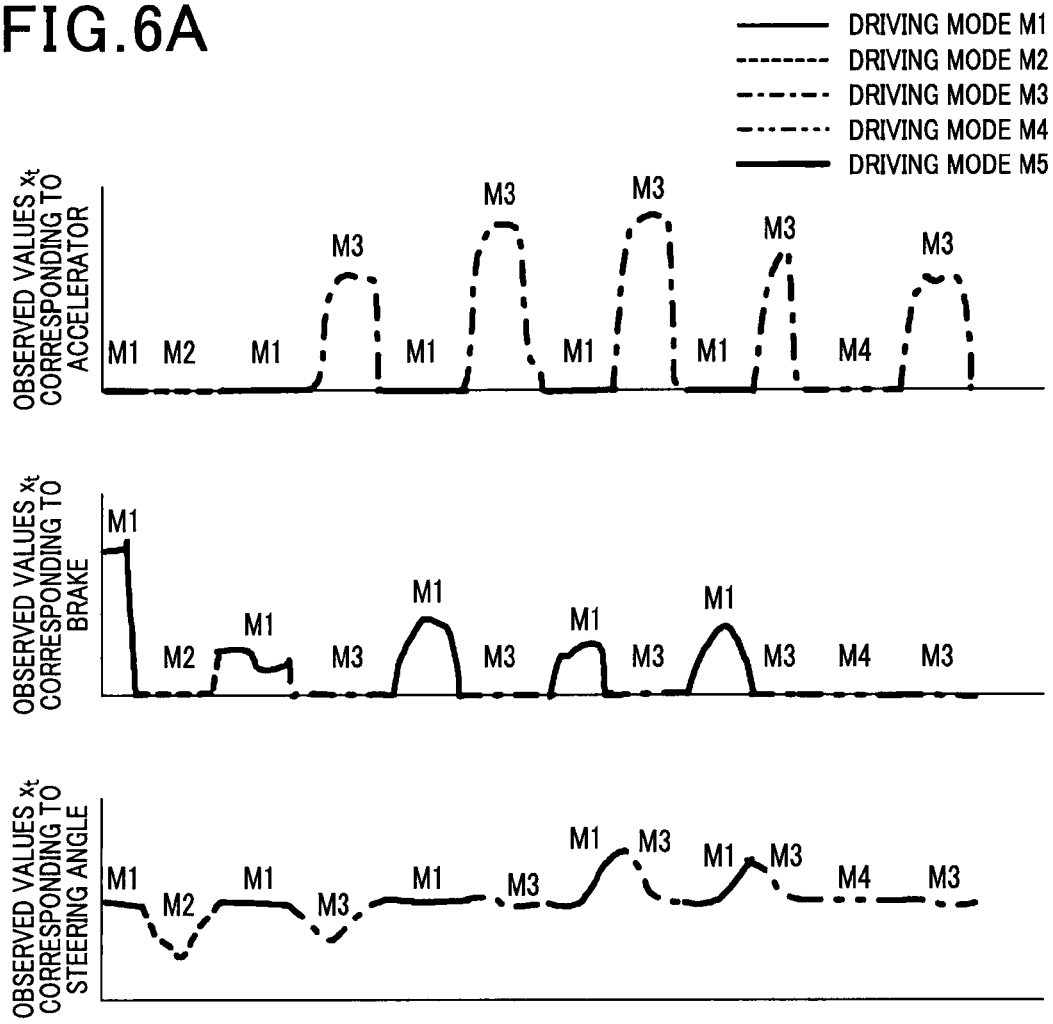
FIG. 6A is graphs each of which schematically illustrates a relationship between an observed-value sequence and driving modes selected therefor according to the embodiment.

FIG. 6A schematically illustrates:

a first observed-value sequence $X_t(1)$ of observed values $x_t$ corresponding to the rate of change of the accelerator operating member, illustrated as "ACCELERATOR";

a second observed-value sequence $X_t(2)$ of observed values $x_t$ corresponding to the pressure of the brake master cylinder, illustrated as "BRAKE"; and a third observed-value sequence $X_t(3)$ of observed values $x_t$ corresponding to the steering angle.

Note that, at each of the observed values $x_t$, one of the driving modes M1 to Mm, which has the highest mode probability $p(z_t|X_t)$, is selected.

FIG. 6A demonstrates that observed values, each of which corresponds to the same driving mode, have a similar tendency, for example, variation.

Figure 6B:
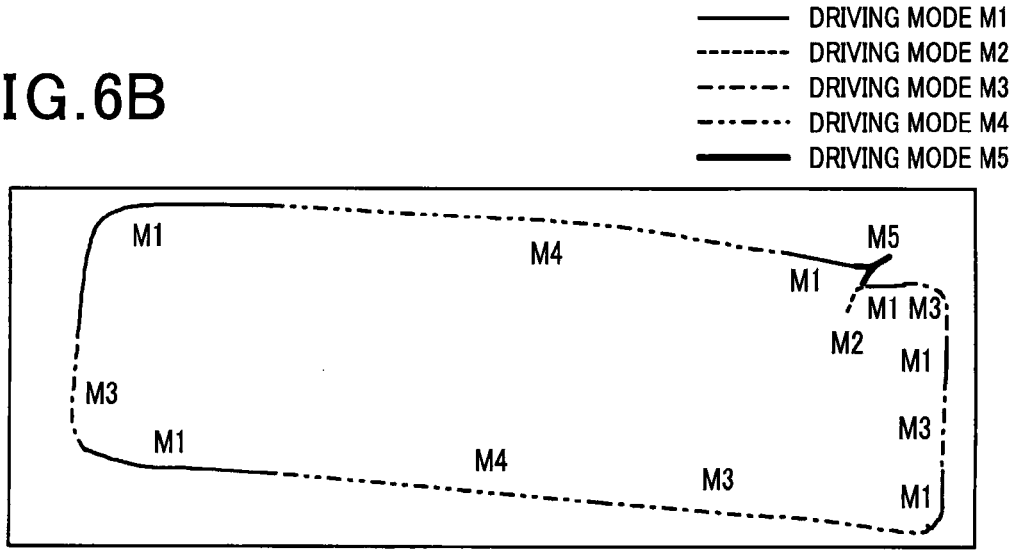
FIG. 6B is a view schematically illustrating estimated driving modes while a motor vehicle is running on a circuit track such that each of the estimated driving modes correlates with a corresponding position of the circuit track.

FIG. 6B schematically illustrates the estimated driving modes based on observed values $x_t$ of an observed-value sequence $X_t$ measured while the motor vehicle V is running on a circuit track such that each of the estimated driving modes correlates with a corresponding position of the circuit track at which the motor vehicle V is travelling. As illustrated in FIG. 6B, how the driving modes vary is based on the shape of the circuit track, and how the driver's driving operations vary is also based on the shape of the circuit track.

Figure 7:
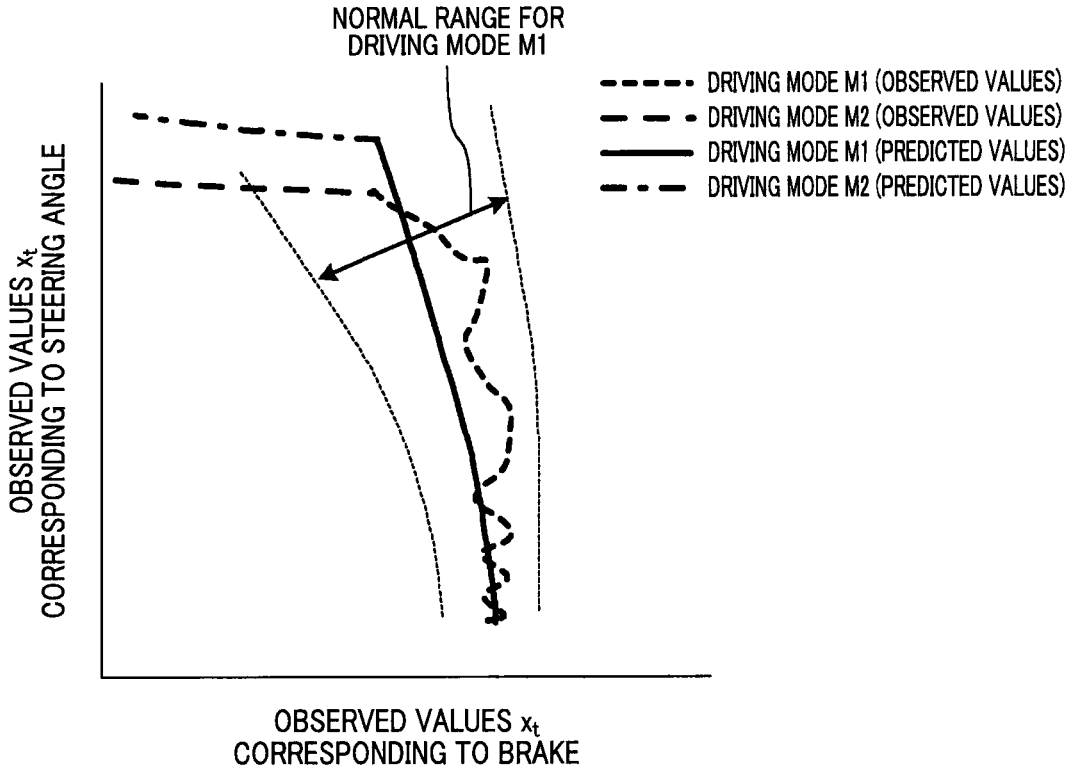
FIG. 7 is a graph schematically illustrating a relationship among.

FIG. 7 schematically illustrates a graph showing:

a first relationship between the second observed-value sequence $X_t(2)$ of observed values $x_t$ corresponding to the pressure of the brake master cylinder and third observed-value sequence $X_t(3)$ of observed values $x_t$ corresponding to the steering angle when the first driving mode M1 is switched to the second driving mode M2;

a second relationship between a sequence of predicted observed values $x_t'$ equal to the values $A_z x_{t-1}$ calculated from the behavior model $A_z$, which corresponds to the second observed-value sequence $X_t(2)$, and a sequence of predicted observed values $x_t'$ equal to the values $A_z x_{t-1}$ calculated from the behavior model $A_z$, which corresponds to the third observed-value sequence $X_t(3)$ when the first driving mode M1 is switched to the second driving mode M2; and a normal range, i.e. an acceptable range, for the first driving mode M1 within which the deviation $d_{z,t}$ of each of the observed values $x_t$ of the second observed-value sequence $X_t(2)$ from a corresponding one of the predicted observed values $x_t'$ ($A_z x_{t-1}$) and the deviation $d_{z,t}$ of each of the observed values $x_t$ of the third observed-value sequence $X_t(3)$ from a corresponding one of the predicted observed values $x_t'$ ($A_z x_{t-1}$) are lower than the first threshold when the first driving mode M1 is switched to the second driving mode M2.

Specifically, as illustrated in FIG. 7, when the deviation $d_{z,t}$ of each of the observed values $x_t$ of the second observed-value sequence $X_t(2)$ from a corresponding one of the predicted observed values $x_t'$ ($A_z x_{t-1}$) and the deviation $d_{z,t}$ of each of the observed values $x_t$ of the third observed-value sequence $X_t(3)$ from a corresponding one of the predicted observed values $x_t'$ ($A_z x_{t-1}$) are lower than the first threshold so as to be within the normal range for the first driving mode M1, it is determined that there are no abnormal driving behaviors of the driver in the first driving mode M1.

In contrast, when either the deviation $d_{z,t}$ of at least one of the observed values $x_t$ of the second observed-value sequence $X_t(2)$ from a corresponding at least one of the predicted observed values $x_t'$ ($A_z x_{t-1}$) or the deviation $d_{z,t}$ of at least one of the observed values $x_t$ of the third observed-value sequence $X_t(3)$ from a corresponding at least one of the predicted observed values $x_t'$ ($A_z x_{t-1}$) is equal to or higher than the first threshold so as to be out of the normal range for the first driving mode M1, it is determined that there is at least one abnormal driving behavior of the driver in the first driving mode M1.

As described above, the abnormal driving behavior detection system 1 according to this embodiment is configured to:

obtain the mode probability $p(z_t|X_t)$ for each of the driving modes M1 to Mm as a function of a target sequence $X_t$ of observed values $x_t$, the mode transition probability $\pi_z$, and the mode-distribution parameters $\mu_z$ and $\Sigma_z$ for a corresponding one of the driving modes M1 to Mm;

obtain the deviation $d_{z,t}$ for each of the driving modes M1 to Mm and the expected value $E_t$ of the deviation $d_{z,t}$ for a corresponding one of the driving modes M1 to Mm as a function of the normal driving-behavior model $A_z$ in a corresponding one of the driving modes M1 to Mm and the mode probability $p(z_t|X_t)$ for a corresponding one of the driving modes M1 to Mm; and determine whether there are abnormal driving behaviors of the driver as a function of the expected value $E_t$ of the deviation $d_{z,t}$ for each of the driving modes M1 to Mm.

Thus, this configuration is capable of detecting abnormal behaviors of the driver without using abnormal behavior models each of which is obtained by modelling driver's driving behaviors when they are abnormal. Thus, it is possible to determine whether there are abnormal driving behaviors of the driver with a higher accuracy and a simpler procedure.

Particularly, the abnormal driving behavior detection system 1 according to this embodiment is configured to obtain the mode probability $p(z_t|X_t)$ for each of the driving modes M1 to Mm in consideration of the mode transition probability $\pi_z$. This configuration makes it possible to determine whether there are abnormal driving behaviors of the driver, which include an abnormality of mode transitions, with a further higher accuracy while ensuring the robustness of the system 1.

In addition, the abnormal driving behavior detection system 1 is configured such that each of the driving modes M1 to Mm and the normal driving-behavior model $A_z$ in a corresponding one of the driving modes M1 to Mm are defined based on the learning process using Beta Process Autoregressive Hidden Markov Model (BP-AR-HMM). This results in automatic determination of the number of the driving modes during the learning process using the BP-AR-HMM; the determined number of the driving modes can be easily processed by computers. Thus, it is possible to more improve the distinguishability of the driving modes in comparison to a case where the number of the driving modes is artificially determined.

The abnormal driving behavior detection system 1 is further configured to:

calculate an average value of a sufficient number of deviations $d_{z,t}$ for each of the driving modes M1 to Mm;

determine whether there is at least one driving mode whose average value is equal to or higher than the second threshold; and upon determination that there is at least one driving mode whose average value is equal to or higher than the second threshold, extract the driver's driving operations included in the at least one driving mode are poor driving operations.

Specifically, the state variables $z_1, z_2, \ldots, z_t$ of a sequence, each of which corresponds to one of the driving modes M1 to Mm, constitute driver's primitive driving factors of a corresponding driving behavior and/or a driving operation. For this reason, upon determination that there is at least one driving mode whose average value of the sufficient number of deviations $d_{z,t}$ for the at least one driving mode is equal to or higher than the second threshold, it is possible to determine that the driver's driving operations included in the at least one driving mode are poor driving operations.

The embodiment of the present disclosure has been described, but the present disclosure is not limited thereto. Specifically, the embodiment can be freely changed or modified within the scope of the present disclosure. For example, one or more functions included in a block of the abnormal driving behavior detection system 1 illustrated in FIG. 1 can be distributed to other blocks of the abnormal driving behavior detection system 1 illustrated in FIG. 1. In addition, functions included in respective blocks of the abnormal driving behavior detection system 1 illustrated in FIG. 1 can be integrated into one block thereof. A part of the abnormal driving behavior detection system 1 according to the embodiment can be replaced with a known structure having the same functions as the part of the abnormal driving behavior detection system 1.

For example, in the embodiment, the information provider 3 provides the determined results of the abnormal driving behavior detection system 1 as at least one of visible information and audible information to an occupant, such as the driver, but the present disclosure is not limited thereto. Specifically, the abnormal driving behavior detection system 1 or another device can be configured to control one or more actuators, such as a brake actuator and/or a steering motor, so as to assist the driver's driving behaviors and/or operations in accordance with the determined results of the abnormal driving behavior detection system 1.

While an illustrative embodiment of the present disclosure has been described herein, the present disclosure is not limited to the embodiment described herein, but includes any and all embodiments having modifications, omissions, combinations (e.g., of aspects across various embodiments), adaptations and/or alternations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

What is claimed is:

1. An abnormal driving behavior detection system for a vehicle, the system comprising:

a sensor that repeatedly obtains an observed value indicative of at least one of a running condition of the vehicle and a driver's driving operation of the vehicle;

a mode-probability calculator that calculates, each time an observed value is obtained at a given obtaining timing as a target obtained value, a mode probability for each of a plurality of driving modes as a function of one or more previous observed values previously obtained before the target obtained value, each of the plurality of driving modes being defined by modelling a group of normal driving behaviors, the mode probability for each of the plurality of driving modes representing a probability that a target driving mode at the given obtaining timing corresponds to a corresponding one of the plurality of driving modes;

a deviation calculator that obtains, for comparison with the target obtained value, a predicted observed value for each of the plurality of driving modes using a driver's normal behavior model defined for a corresponding one of the plurality of driving modes, and calculates a deviation of the target observed value from the predicted observed value for each of the plurality of driving modes; and an abnormality determiner that determines whether there is at least one driver's abnormal behavior based on the mode probability for each of the plurality of driving modes and the deviation calculated for each of the plurality of driving modes.

2. The abnormal driving behavior detection system according to claim 1, wherein the abnormality determiner:

calculates, based on the mode probability for each of the plurality of driving modes and the deviation calculated for each of the plurality of driving modes, an evaluation value of the deviation calculated for each of the plurality of driving modes; and determines whether there is at least one driver's abnormal behavior based on the evaluation value of the deviation calculated for each of the plurality of driving modes.

3. The abnormal driving behavior detection system according to claim 2, wherein the abnormality determiner:

determines whether the evaluation value of the deviation calculated for each of the plurality of driving modes is equal to or higher than a first threshold; and determines that there is at least one driver's abnormal behavior upon determination that the evaluation value of the deviation calculated for at least one of the plurality of driving modes is equal to or higher than the first threshold.

4. The abnormal driving behavior detection system according to claim 1, wherein each of the plurality of driving modes is defined by modelling the group of normal driving behaviors using Beta Process Autoregressive Hidden Markov Model.

5. The abnormal driving behavior detection system according to claim 2, wherein the abnormality determiner performs a weighted addition of the deviation for each of the plurality of driving modes using, as a weight coefficient, the mode probability for a corresponding one of the plurality of driving modes, thus calculating the evaluation value of the deviation calculated for each of the plurality of driving modes.

6. The abnormal driving behavior detection system according to claim 1, wherein:

the deviation calculator calculates a preset number of the deviations of a corresponding number of the target observed values from a corresponding number of the predicted observed values for each of the plurality of driving modes, the abnormal driving behavior detection system further comprising:

an average-value calculator that calculates an average value of the preset number of the deviations for each of the plurality of driving modes; and a poor operation determiner that:

determines whether the average value for each of the plurality of driving modes is equal to or higher than a second threshold; and upon determination that the average value for at least one of the plurality of driving modes is equal to or higher than the second threshold, determine that there is at least one poor driving operation of the driver in the at least one of the plurality of driving modes.

7. A program product usable for an abnormal driving behavior detection system for a vehicle, the program product comprising:

a non-transitory computer-readable medium; and a set of computer program instructions embedded in the computer-readable medium, the instructions causing a computer of a security system to:

repeatedly obtain an observed value, using a sensor, indicative of at least one of a running condition of the vehicle and a driver's driving operation of the vehicle;

calculate, each time an observed value is obtained at a given obtaining timing as a target obtained value, a mode probability for each of a plurality of driving modes as a function of one or more previous observed values previously obtained before the target obtained value, each of the plurality of driving modes being defined by modelling a group of normal driving behaviors, the mode probability for each of the plurality of driving modes representing a probability that a target driving mode at the given obtaining timing corresponds to a corresponding one of the plurality of driving modes;

obtain, for comparison with the target obtained value, a predicted observed value for each of the plurality of driving modes using a driver's normal behavior model defined for a corresponding one of the plurality of driving modes;

calculate a deviation of the target observed value from the predicted observed value for each of the plurality of driving modes; and determine whether there is at least one driver's abnormal behavior based on the mode probability for each of the plurality of driving modes and the deviation calculated for each of the plurality of driving modes.

* * * * *